United States Patent [19]

Ross

[11] 3,985,106

[45] Oct. 12, 1976

[54] SAILBOAT STABILIZING SYSTEM

[76] Inventor: Abraham D. Ross, 501 Van Ness Ave., Bldg. B, Torrance, Calif. 90501

[22] Filed: Feb. 25, 1975

[21] Appl. No.: 552,990

[52] U.S. Cl. ..... 114/91; 114/138

[51] Int. Cl. ..... B63B 15/00

[58] Field of Search ..... 114/39, 91, 124, 126, 114/132, 135–138, 140, 141, 143

[56] References Cited

UNITED STATES PATENTS

| | | | |
|---|---|---|---|
| 236,237 | 1/1881 | McLeod | 114/91 |
| 559,983 | 5/1896 | McLean | 114/124 |
| 595,161 | 12/1897 | Gibb | 114/137 |
| 1,375,400 | 4/1921 | Ljungstrom | 114/91 |

*Primary Examiner*—Stephen G. Kunin
*Assistant Examiner*—Sherman D. Basinger
*Attorney, Agent, or Firm*—Allan M. Shapiro

[57] ABSTRACT

Mast is pivoted to sailboat hull and carries a counter-balance weight below the pivot. Wind pressure causes mast heeling with the counter-balance supplying the mast-righting force. Additionally, movable weights in the hull bottom are cable-connected to the mast so that, upon mast heeling with respect to the hull, the weights are moved upward and outward. The underwater structure of the sailboat is also controlled by mast listing or heeling. When centerboard-equipped, the centerboard is lowered with mast heeling. When keel-equipped, the pivoted keel is swung for maximum stability.

9 Claims, 10 Drawing Figures

Fig. 1
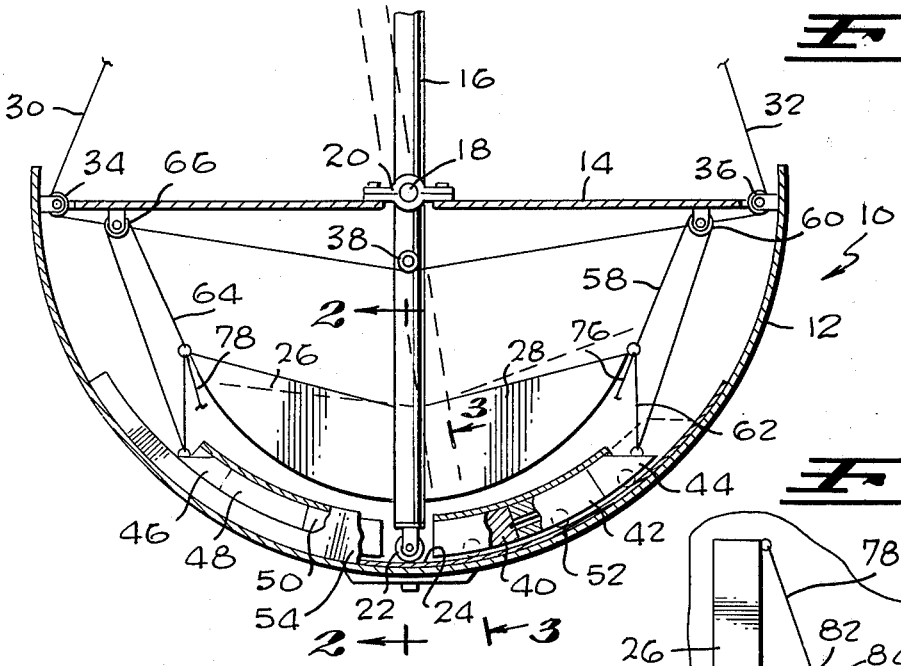
Fig. 4
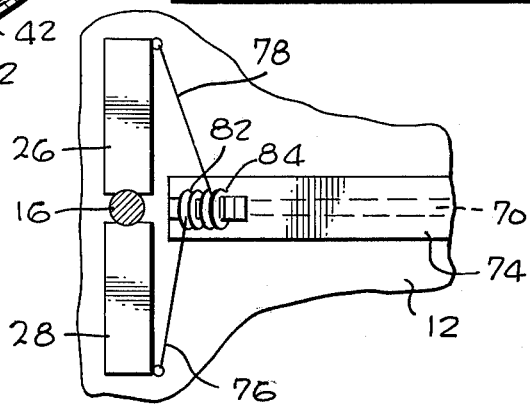
Fig. 2
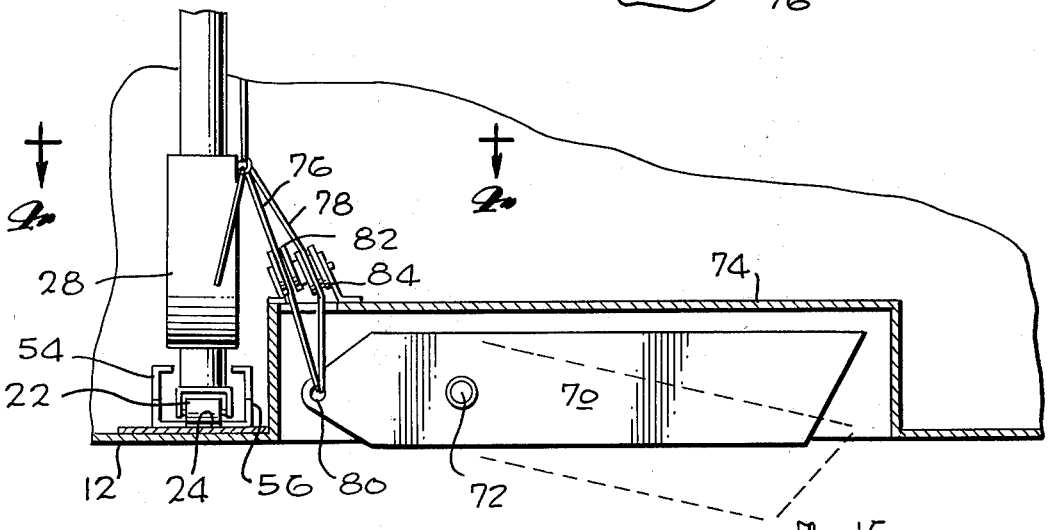
Fig. 3
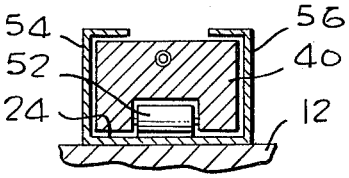
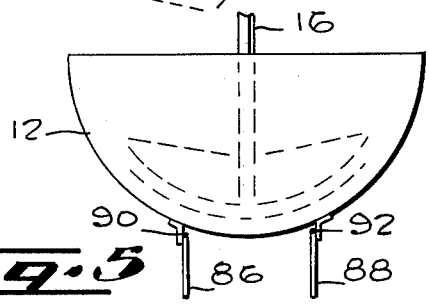
Fig. 5

SAILBOAT STABILIZING SYSTEM

BACKGROUND OF THE INVENTION

1. Field of the Invention

This invention relates to mono-hull sailing craft equipped with structures which maintain a generally upright hull, despite mast heeling.

2. Description of the Prior Art

In the conventional sailboat, the mast is fixed to the hull. When wind force on the sail causes heeling, the mast and hull heel or list together. The mast relies solely upon the righting action of the hull to provide a returning force tending to right the hull. The righting force is usually accomplished by a leeward positioning of the center of buoyancy. As long as the center of buoyancy continues to move in the leeward direction with respect to the center of gravity with increasing heel, stability is achieved; however the increasing heel of the hull itself is uncomfortable to the sailor and his passengers. As for as passenger comfort is concerned, the hull should remain virtuually level: therefore another righting force for the mast in opposition to the wind force should be found, rather than the forces resulting from heeling of the hull.

SUMMARY OF THE INVENTION

In order to aid in the understanding of this invention, it can be stated in essentially summary form that it is directed to a sailboat stabilizing system wherein the sailboat mast is pivoted with respect to the sailboat hull. Below the pivot, the mast carries a counterweight. Additionally, movable weights are positioned in the sailboat hull, and the weights are connected to be moved by heeling of the mast with respect to the hull to provide additional stabilizing forces.

It is thus an object of this invention to provide a sailboat stabilizing system which includes a mast subject to wind force which is pivoted on a hull. It is another object to provide counter-weights on the mast below its pivot to provide a returning force to tend to return the mast to its upright position. It is another object to provide additional stabilizing weights mounted in the hull and connected to the mast to be moved by mast heeling with respect to the hull.

It is another object of this invention to provide a sailboat where the underwater structure is moved in accordance with heeling of the sailboat so that sailboat stability is enhanced. It is a further object to provide a sailboat with a centerboard wherein the centerboard is connected to the mast which is pivoted with respect to the hull so that the centerboard is lowered whenever the mast lists with respect to the hull. It is a further object to provide a sailboat with a pivoted keel wherein the keel pivots with respect to the hull whenever the mast lists with respect to the hull. It is a further object to provide hydraulic interconnection between the pivoted keel and the listing mast together with hydraulic valving to selectively lock the mast with respect to the hull and/or lock the keel with respect to the hull for particular sailing conditions. It is yet another object to provide both movable counterweights within the hull controlled by the listing mast and underwater structure in connection with the hull connected to be controlled by the listing mast.

The features of the present invention which are believed to be novel are set forth with particularity in the appended claims. The present invention, both as to its organization and manner of operation, together with the further objects and advantages thereof, may be best understood by reference to the following description, taken in conjunction with the accompanying drawings.

BRIEF DESCRIPTION OF THE DRAWINGS

FIG. 1 is a transverse section through a sailboat having the stabilizing system of this invention.

FIG. 2 is an enlarged section, with parts broken away, taken generally along the line 2—2 of FIG. 1.

FIG. 3 is an enlarged section, with parts broken away, taken generally along the line 3—3 of FIG. 1.

FIG. 4 is a plan view on reduced scale, with parts broken away, as seen generally along the line 4—4 of FIG. 2.

FIG. 5 is a bow-elevational view of another embodiment of the sailboat stabilizing system of this invention.

DESCRIPTION OF THE PREFERRED EMBODIMENT

Figure 6:
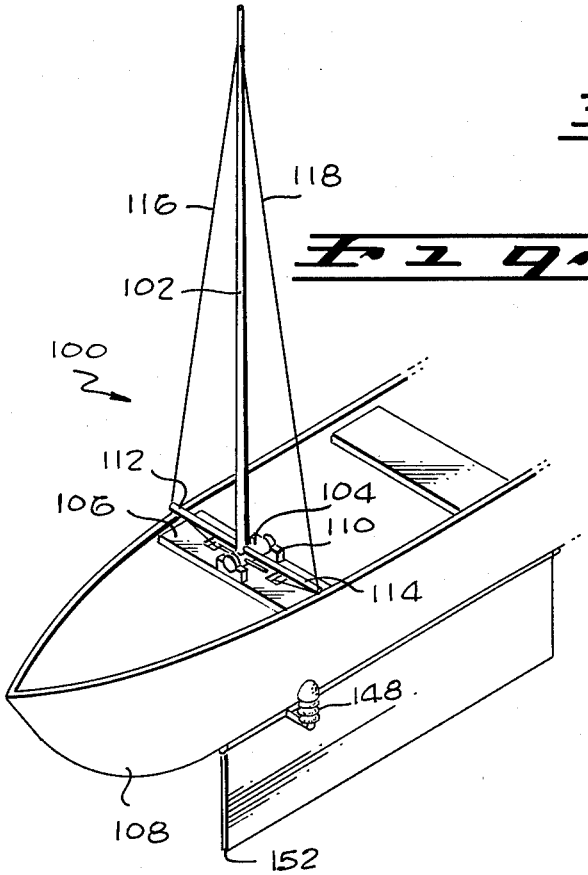
FIG. 6 is an isometric view, with parts broken away, showing the sailboat in accordance with this invention having the listing mast and a pivoted keel which is hydraulically connected to the mast to pivot with mast listing.

The sailboat having a stabilizing system of this invention is generally indicated at 10 in FIG. 1. Sailboat 10 has a hull 12 which is substantially water-impervious and which has a configuration which provides for upright floating stability in the water. Hull 12 carries a deck 14 which covers at least a portion of the otherwise upwardly open hull 12. Deck 14 can serve to support the sides of the hull, as well as support a mast pivot. Mast 16 carries trunnion 18 which is mounted in mast pivot bearing 20 which is secured to deck 14.

The foot of mast 16 carries wheel 22 which engages in track 24 secured to hull 12. Track 24 is arcuate and partially circular about the center of trunnion 18 so that, as the mast pivots with respect to the hull (for example, from the full line to the dotted line position of FIG. 1), wheel 22 moves along track 24 to provide additional support for mast 16.

Counter-weights 26 and 28 are secured to the bottom of the mast just above its wheel 22 and are of equal size and weight so that counter-weights 26 and 28 tend to swing mast 16 upright with respect to gravity. Since hull 12 is intended to float upright, the same force tends to swing mast 16 upright with respect to hull 12. Stays 30 and 32 are secured toward the top of mast 16 and respectively pass around pulleys 34 and 36 which are positioned at the juncture between hull 12 and deck 14. Below deck 14, the stays extend around pulley 38 which is secured to the mast below deck 14. Stays 30 and 32 provide support and stability for the mast.

From this construction, it can be seen that each of the mast and hull is independently urged toward the upright position. When wind acts upon the sail on mast 16, there is a force to the leeward. This force on the sail causes rotation of the mast about its pivot point at trunnion 18. The counter-weights provide the mast returning, stabilizing force.

For additional hull stabilization, a plurality of moving weights in the hull are provided. Segmental weights 40, 42, and 44 are positioned on track 24 on one side of the mast, and segmental weights 46, 48 and 50 are positioned on track 24 on the other side of the mast. These separate sets of segmental weights are connected together and are movably mounted on the track on rollers, such as roller 52 (see FIG. 3). These sets of segmental weights are arcuately shaped to fit the curvature of the track. These sets of segmental weights are restrained by flanged guides 54 and 56 which engage around and embrace the sets of segmental weights.

Cable 58 is attached to counter-weight 28 and extends up over pulley 60 and, at its other end, is attached to weight 44. Cable 62 is connected directly from the end of the counter-weight 28 to segmental weight 44. Now, when the mast 16 rotates in the counter-clockwise direction with respect to hull 12, cable 62 raises the segmental weights 40, 42 and 44, and cable 58 is slack. When mast 16 rotates in the clockwise direction with respect to the hull, cable 58 becomes tight and raises that set of segmental weights upward along its track in the hull.

Similarly, cable 64 is connected from the upper outside corner of counter-weight 26 up over pulley 66 and down to segmental counter-weight 46. Cable 68 is connected directly from the upper, outer corner of counter-weight 26 to the segmental weight 46 so that, with either rotation of mast 16 with respect to the hull, the set of segmental weights, including weight 46, is also raised. Thus, with either rotation of the mast with respect to the hull, both of the sets of segmental weights are raised to provide mast returning, stabilizing forces.

The use of cables to operate the arcuate weights and move them along their tracks is the preferred embodiment. Another embodiment employs the use of hydraulics. In such an embodiment, the mast is connected to a hydraulic pump, such as a piston and cylinder so that, when it lists in either direction, hydraulic fluid is displaced. The arcuate weights are connected to a motor, such as another piston and cylinder for each side of the hull with piping and valving so that, upon listing of the mast in either direction, both sets of weights are moved upward in the hull track as for the previously described embodiment. In both the cable-operated and hydraulically operated embodiments, the connections can be made so that only the windward weight rides upward in its track to move the center of gravity of the hull to the windward side.

Center board 70 is pivoted at 72 inside center board trunk 74. When the front end of the center board is raised inside the trunk, the rear of the center board swings down into the water. The center board provides lateral stability for the sailboat to reduce lateral drift due to wind pressure on the sail and the hull.

The center board is only needed when there is a lateral wind force. Cables 76 and 78 are connected to the forward eye 80 of the center board and pass up over pulleys 82 and 84. The upper ends of these cables are connected to the upper, outer corners of counter-weights 26 and 28, see FIG. 1. Thus, when the mast heels in either direction due to wind pressure, the center board is pulled down. This provides a further portion of the stabilizing system.

In the embodiment where a hydraulic pump is connected to be actuated by listing of the mast with respect to the hull, a hydraulic motor such as a piston and cylinder can be connected to the centerboard 70 so that the centerboard is hydraulically lowered whenever the mast lists with respect to the hull and is raised when the mast is upright with respect to the hull.

FIG. 5 illustrates a further embodiment of the stabilizing system which includes the same hull 12 and mast 16. They are pivoted and counter-weighted and provided with the segmental weights and interconnecting cable systems, as previously described; however in the structure of FIG. 5, the hull does not have a center board, but instead, has first and second keels 86 and 88. Keels 86 and 88 are respectively pivoted or hinged to the hull by pivots 90 and 92. The pivoted keels are each arranged so that they can swing inward toward the hull center line, but cannot swing outward more than about vertical with respect to the hull. In this way, the keels can fold up for trailer hauling of the sailboat, but provide lateral stabilization. With the mast and hull stabilization system, the pivoted keels can be maintained considerably closer to perpendicular to the water surface for maximum efficiency.

Sailboat 100, illustrated in FIGS. 6–9 has mast 102 which is carried on trunnion 104 which is pivoted on deck 106. Deck 106 can be a partial deck or one which extends over the entire forepart of the vessel. Deck 106 extends at least across the hull 108 to support and strengthen the sides of the hull and to be supported thereby. As shown in FIG. 6, trunnion 104 is pivotable in saddle bearings 110. Spreaders 112 and 114 are secured to the mast just above the level of deck 106. Shrouds 116 and 118, preferably in the form of wire stays, are secured to mast 102 adjacent its top end to extend around the outer ends of the spreaders. Below deck 106, shrouds 116 and 118 engage around drum 120. Spreaders 112 and 114 are positioned just above the deck so that a limited amount of listing of the mast can occur before the ends of the spreaders 112 and 114 respectively engage stops 122 and 124 to limit listings. By this construction, wind force against the sail on mast 102 causes listing of the mast with respect to the hull with pivoting on trunnion 104 so that the shrouds cause rotation of drum 120.

Drum 120 is fixed on shaft 126 which rotates in its own bearings. Cross arm 128 through shaft 126 engages on the piston rods 130 and 132 which are connected to operate pistons in cylinders 134 and 136. Hydraulic fluid is moved into and out of the cylinders by a motion of the pistons. Hydraulic valves 138 and 140 are respectively connected in the hydraulic fluid lines 142 and 144 which extend from the cylinders for connecting the hydraulic fluid.

Bellows 146 and 148 are respectively connected to these hydaulic fluid lines. The mechanical output of the bellows is connected to cross arm 150. Keel 152 is pivoted on the bottom of hull 108 and is connected to cross arm 150 so that the angular position of the keel beneath the hull is controlled. Valves 134 and 136 are controlled by manual control handle 154. In the first position, the hydraulic flow is directly connected so that downward motion of piston 130 causes downward motion of bellows 146 and there is no cross-over flow. In the second position, both valves are closed so that both the position of mast 102 and the position of keel 152 are fixed. Blockage of the hydraulic lines prevents mechanical motion thereof.

Figure 7:
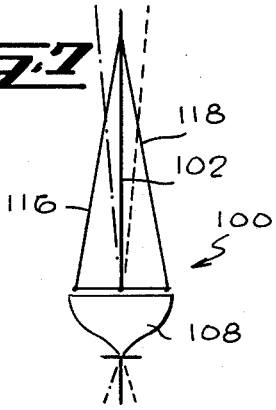
FIG. 7 is a front elevational view of the boat of FIG. 6 showing the relative listing of the mast and pivoting of the keel.
Figure 9:
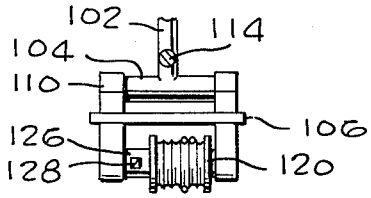
FIG. 9 is a partial section taken along the line 9—9 of FIG. 8 showing details of the portion of the structure.

In the third position, the flow is crossed over so that downward motion of piston rod 132 causes downward motion of bellows 146, with the opposite action of the other parts. FIG. 7 shows the relative pivoting of the parts for the preferred, first described position of the valves. That figure shows in full lines that, when the mast is upright with respect to the hull, the keel is straight down. When the mast moves to the dotted line position, the keel moves to the dotted line position on the same side. When the mast moves to the dot and dash line position, the keel moves to the dot-dash line position on the same side.

The stabilizing system of FIGS. 6, 7, 8 and 9 relates only to the relationship between mast listing and angular displacement of keel 152. If desired, added to this combination can be the segmental weight system and counter-weight system of FIGS. 1 through 4. Thus, in such a construction, listing of the mast with respect to the hull not only causes pivoting of the keel, but also causes relative motion of weights to urge the mast toward the upright position and provides for movement of weights with respect to the hull to increase hull stability.

Figure 10:
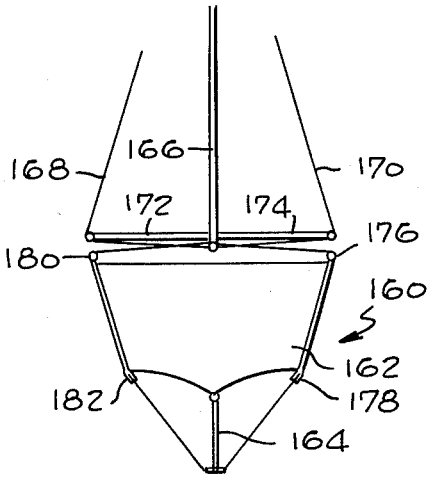
FIG. 10 is a front elevational view of another embodiment of the interconnection between the listing mast and the pivoted keel of the sailboat stabilization system of this invention.
Figure 8:
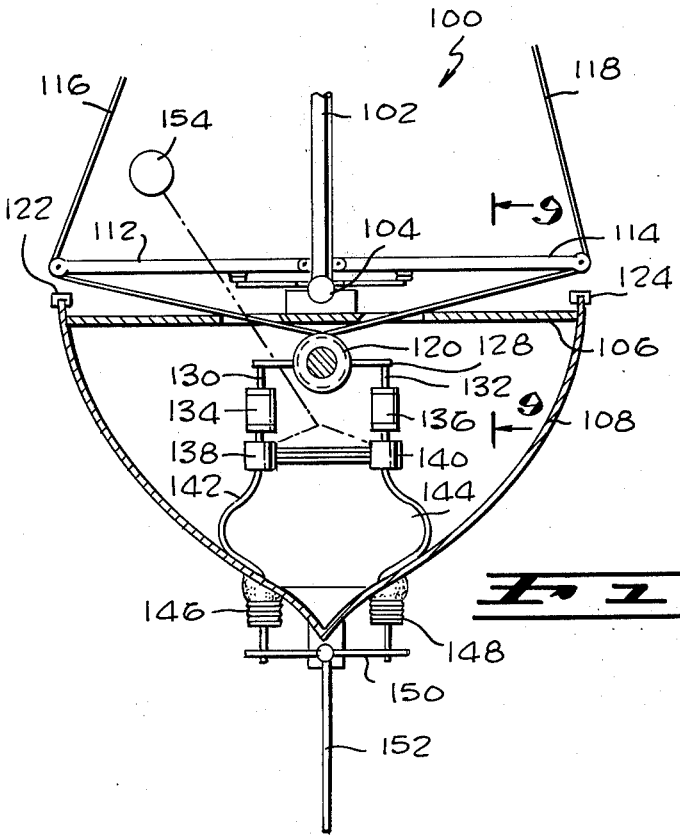
FIG. 8 is a transverse section through the sailboat of FIG. 6 forward of the mast to show the listing structures which interconnect the mast with the pivoted keel.

FIG. 10 shows another embodiment of a sailboat stabilizing system similar to the embodiment of FIGS. 6 through 9 wherein listing of the mast causes pivoting of the keel. Sailboat 160 has a hull 162 which carries a pivoted keel 164 on its bottom. The keel is pivoted on a longitudinal axis similar to the keel 152. The upper part of sailboat 160 includes mast 166 which is supported by stays 168 and 170. Stays 168 and 170 respectively pass around spreaders 172 and 174 which are secured to the mast just above deck level. The outer ends of the spreaders engage with hull stops upon listing of the mast to limit the maximum angular list. Stays or shrouds 168 and 170 extend around the spreaders and cross over below the pivot point of the masts and extend around hull-mounted pulleys to be secured to the lower edge of keel 164. Stay 168 extends over hull-mounted pulleys 176 and 178, while stay 170 extends over pulleys 180 and 182. This arrangement of the stays causes the keel to be drawn to the same side toward which the mast lists. With side thrust on the mast due to wind force on the sail, the mast is listed and, with the keel pivoted in the same direction, greater effectiveness in restraint against side drift is achieved.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A sailboat having a sailboat stabilizing system comprising:

a sailboat hull;

a mast pivotally mounted on a pivot point with respect to said hull, a partially circular arcuate track in said hull having its center point substantially at said pivot point;

a counter-weight secured to said mast below said pivot point to urge said mast forward in upright position;

said mast engaging in said track so that said track provides support to said mast from said hull;

a movable non-resilient weight positioned to move on and be supported on said mast-supporting track, said movable weight being connected to said mast so that, as said mast rotates about its pivot, said movable weight is moved in said hull.

2. The sailboat of claim 1 wherein said movable weight is arcuately curved to fit said track, said movable weight having a plurality of rollers therein for rolling on said track.

3. The sailboat of claim 2 wherein a flanged guide extends over said movable weight to restrain said movable weight adjacent said track.

4. The sailboat of claim 1 wherein there are first and second movable weights respectively positioned on opposite sides of said mast in said hull, each of said mast weights to be raised when said mast rotates about its pivot with respect to said hull.

5. The sailboat of claim 4 wherein said first and second movable weights are arcuately curved to fit said track, said movable weights each having a plurality of rollers therein for rolling on said track.

6. The sailboat of claim 5 wherein a flanged guide extends over the first and second movable weights to restrain said movable weights adjacent said track.

7. The sailboat of claim 4 wherein first and second cables are respectively connected between said mast and said first and second movable weights so that, when said mast is rotated with respect to said hull, both of said movable weights are moved upward along said track within said hull.

8. The sailboat of claim 1 further including a center board within said hull, a cable connecting said mast to said center board so that, when said mast is rotated with respect to said hull, said center board is extended from said hull.

9. The sailboat of claim 1 further including first and second hinged keels secured to the exterior of said hull, said hinged keels being separately oppositely hinged so that each resists lateral water force with respect to said hull in opposite directions.

* * * * *